US005816945A

United States Patent [19]

Todd et al.

[11] Patent Number: 5,816,945

[45] Date of Patent: Oct. 6, 1998

[54] HOCKEY TRAINING DEVICE

[76] Inventors: Phillip P. Todd; Kevin P. Todd, both of 7248 Twin Lakes Ave., Centerville, Minn. 55038

[21] Appl. No.: 780,405

[22] Filed: Jan. 9, 1997

[51] Int. Cl.[6] ..... A63B 59/14

[52] U.S. Cl. ..... 473/425

[58] Field of Search ..... 273/329, 330; 473/425, 424, 446, 463

[56] References Cited

U.S. PATENT DOCUMENTS

| | | | |
|---|---|---|---|
| 667,563 | 2/1901 | Oakley | 473/24 |
| 795,960 | 8/1905 | Cook | 473/24 |
| 3,863,917 | 2/1975 | Beale | 472/225 |
| 4,023,797 | 5/1977 | Sarrasin | 472/225 |
| 4,111,419 | 9/1978 | Pellegrino | 473/225 |
| 5,120,055 | 6/1992 | McCarthy | 473/225 |
| 5,465,958 | 11/1995 | Brun | 273/57.2 |

*Primary Examiner*—Theatrice Brown
*Attorney, Agent, or Firm*—Jacobson & Johnson

[57] ABSTRACT

A hockey training device comprising a leader having a swivel attached to one end thereto permit rotation of leader without twisting of the leader and a stop attached to second end of the leader for securing the leader to a hockey puck to enable a person to practice puck handling, a looped member connected to the swivel, a strap having a hook and loop type fastener for releasably securing the strap to a hockey stick and an elastic member having a first end secured to the strap and a second end secured to the split ring for absorbing shocks.

9 Claims, 2 Drawing Sheets

HOCKEY TRAINING DEVICE

FIELD OF THE INVENTION

This invention relates generally to hockey devices and, more particularly, to a hockey training device with replaceable parts.

BACKGROUND OF THE INVENTION

The concept of hockey training devices wherein a hockey puck is tethered to a hockey stick to enable a user to practice puck handling is known in the art. In one embodiment the hockey puck is tethered to the blade of the hockey stick and in another embodiment the hockey puck is tethered to the hockey stick though a reel.

One of the difficulties with prior art hockey training devices is that the tethering line breaks and needs replacement. A further disadvantage is that the puck will bounce and turn as one practices handling the puck which twists and weakens the tethering line as well as requiring the user to periodically untwist the tethering line.

The present invention comprises an improved hockey training device that prevents twisting of the tethering line and in addition allows one to quickly replace a tethering line if the tethering line should accidentally break. In addition the hockey training device can be tethered to a conventional hockey puck using a conventional drill.

SUMMARY OF THE INVENTION

Briefly, the invention comprises a hockey training device comprising a leader having a first end with a stop for securing to a hockey puck and a second end including a swivel to inhibit twisting of the leader, a split ring for releasably mounting the closed end of a swivel thereto, a shock absorbing material for absorbing shocks and a strap for securing the hockey training device to a hockey stick.

DESCRIPTION OF THE PRIOR ART

U.S. Pat. No. 3,863,917 discloses a hockey training stick with the blade of the stick having a plurality of spaced holes for tethering a hockey puck thereto.

U.S. Pat. No. 4,023,797 discloses a hockey puck tethering device that attaches to the shaft of a hockey stick with the tethering device using a reel to adjust the length of the tether.

U.S. Pat. No. 5,120,055 discloses a hockey puck tethering device where the cord is attached to a binder clip that fastens to the blade of the hockey stick.

U.S. Pat. No. 4,111,419 discloses a practice hockey puck with metal members for practicing on a driveway.

U.S. Pat. No. 5,465,958 shows a off-ice hockey shooting device with a resilient tether.

DESCRIPTION OF THE PREFERRED EMBODIMENT

Figure 1:
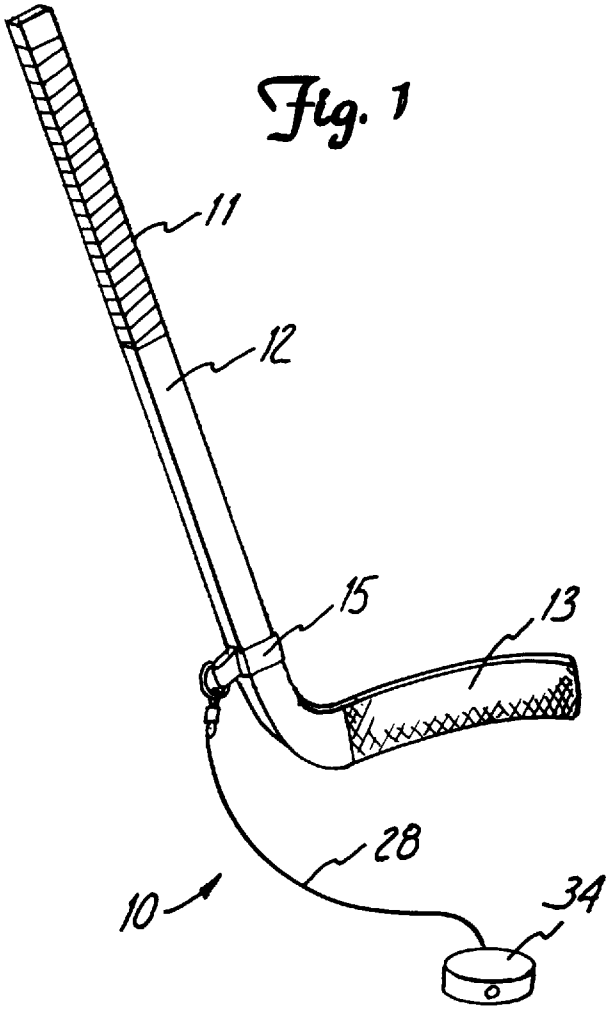
FIG. 1 is a perspective view of the hockey training device attached to a hockey stick.

FIG. 1 shows the hockey training device of the present invention which is identified by reference numeral 10. Hockey training device 10 attaches to handle 12 of hockey stick 11 at the junction between blade 13 and handle 12 with hockey training device including a puck 34 and a replaceable leader 28 which is attached to hockey stick 11 through a releasable strap 15.

Figure 2:
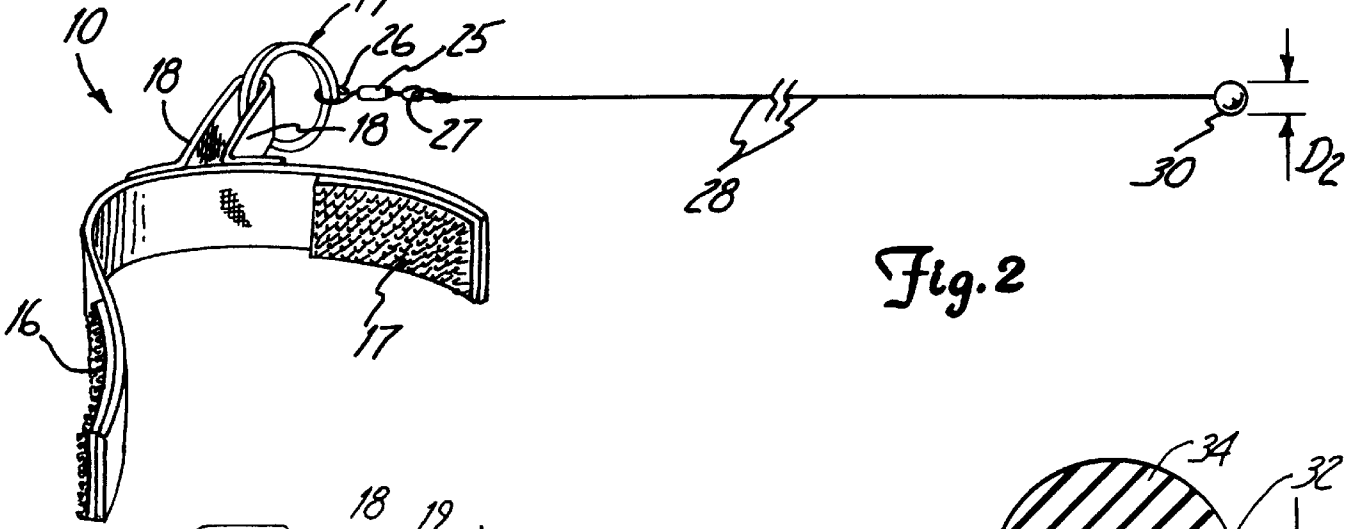
FIG. 2 is a perspective view of the hockey training device without the hockey puck attached thereto.

FIG. 2 shows hockey training device 10 to comprises a flexible fabric strap 15 having a first end with a loop type fastener 16 and a second end with a hook type fastener 17.

Fasteners 16 and 17 are known in the art and are commercially available as VELCRO fasteners. The fasteners can engage each other to releasably secure the strap 15 to hockey stick 11. Connected to strap 15 is an elastic member 18 having a loop for engaging a ring 19. Attached to ring 19 is a swivel 25 having a first eye 26 and a second eyed 27. Swivel 25 is a fishing swivel, which is commonly used as part of a fishing tackle rig. Connected to one end of swivel 25 is a leader 28 having a stop comprising a plastic bead 30 of diameter $D_2$ secured thereto. Leader 28 is a conventional fishing leader having a steel center and a nylon covering.

Figure 3:
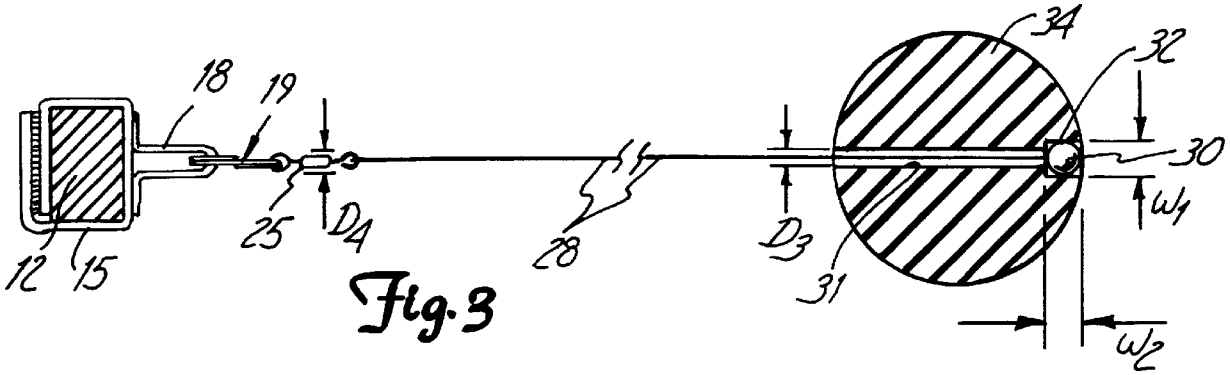
FIG. 3 is to view partially in section of the hockey training device attached to a hockey puck.

FIG. 3 shows the hockey training device 10 attached to a hockey handle 12 with elastic member 18 located between strap 15 and swivel 25. The leader 28 extends diametrically through a cylindrical hole 31 located centrally in hockey puck 34 with bead 30 located in a cylindrical recess 32 in hockey puck 34. Cylindrical hole 31 has a diameter designated by $D_3$ and recess 32 a diameter designated by $D_1$. Recess 32 extends inward a distance $w_2$ with the distance $w_2$ greater than the diameter $D_2$ so that the bead or stop 30 does not protrude outside the cylindrical face of the hockey puck. The maximum diameter $D_4$ of swivel 25 is less than the hole diameter $D_3$ of hockey puck 34 to enable the swivel 25 to be threaded through hockey puck 34. In order to maintain stop 30 in recess 32, stop 30 should form a slight interference fit with the sidewalks of recess 32. However, if stop 30 should come out of the puck the use of a plastic bead as a stop ensures that no metal objects will get accidentally left on the ice should the stop come free of the puck.

Figure 4:
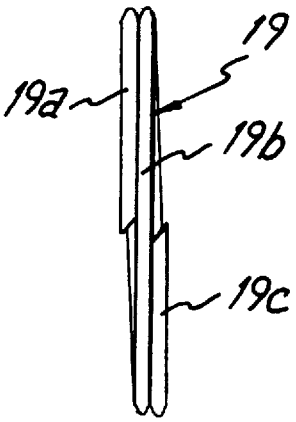
FIG. 4 is a side view of the split ring for attachment to the hockey training device.

FIG. 4 shows a side view of a conventional split ring 19 often used in key chains. The split ring includes a first end 19*a*, a central portion 19*b* and a second end 19*c*. The resiliency of the metal ring permits one to thread a loop on a swivel thereon. The split ring permits one to apply and remove a looped object therefrom without having to open a snap as a swivel loop can be slid along the ring until the ring engages the swivel loop.

Figure 5:
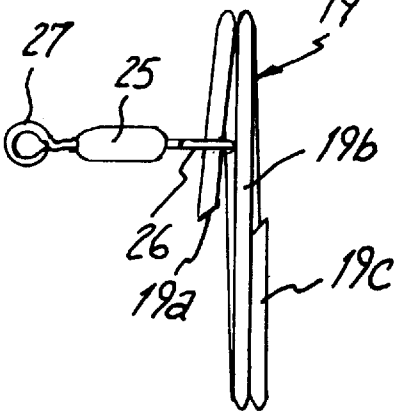
FIG. 5 shows a closed loop swivel eye being attached to the split ring.

FIG. 5 shows the spilt ring portion 19*a* pried upward by loop 26 to enable loop 26 to be slid around first end 19*a* until the loop is engagement with central portion 19*b*. Thus the split ring enables one to readily attach or detach a closed loop swivel therefrom.

Figure 6:
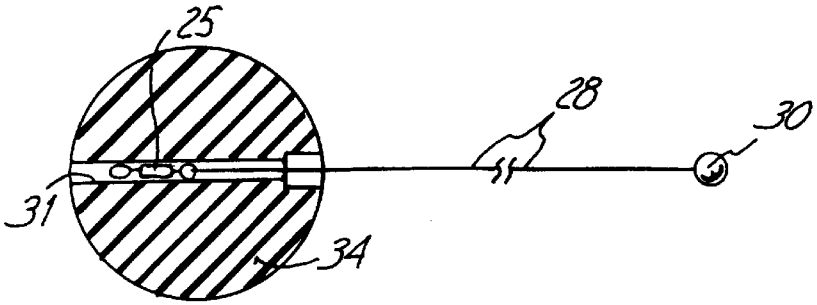
FIG. 6 shows the swivel and leader being threaded through a hockey puck to provide a tether for the hockey puck.

FIG. 6 shows a leader and swivel 25 being threaded though opening 31 in hockey puck 34 to enable a person to replace the leader in the event the leader or swivel are broken.

In operation of the invention the person can maintain the hockey puck 34 proximate the blade 13 as the person practices carrying the puck with the stick. If the puck 34 should fall off the blade 13 the tether 28 prevents the puck from sliding away from the user. The user merely moves the blade until the blade is again in position to carry the puck. Thus the user can readily practice the handling of a puck without continually having to chase after the puck should the puck slide off the blade of the hockey stick.

In the event that the player decides to shoot the puck the elastic member 18 absorbs the initial shock in order to prevent over stressing and breaking of the swivel and the leader. However, if the swivel or leader do break a person can readily replace the leader and swivel by detaching swivel 25 from split ring 19. Once the swivel is detached a new leader with swivel and stop can be attached to puck 34 and split ring 19. FIG. 6 illustrates how the swivel 25 can be threaded through hockey puck 34. Once swivel 34 is threaded though the hockey puck 34 the person can then pull on leader 28 until stop 30 rests within the confines of recess 32. Thus with the present invention one can quickly replace a broken tether or even substitute a longer or a stronger tether for one in the hockey training device. As the swivel and leader can come from conventional fishing tackle the replacement of the broken swivel and leader can be completed inexpensively.

In addition the preparation of a new puck for use with the invention can be done using conventional shop drill. Briefly, the method of making hockey puck ready for attachment to a hockey training device comprises the step of drilling a first hole through the puck along a diametrical axis of the puck until and then drilling a second larger hole partially into the puck with the larger hole located coaxial with said diametrical axis so that the two holes form a shoulder for retaining a stop thereon.

We claim:

1. A hockey training device to enable a person to practice puck handling comprising:

a leader, said leader having a first end and a second end;

a stop attached to said second end for securing said leader to a hockey puck;

a swivel attached to said first end to permit rotation of said leader without twisting of the leader;

a split ring connected to said swivel and wherein said swivel has a closed loop engaging said split ring; and a strap, securable to a hockey stick and to said swivel to thereby hold a hockey puck proximate said hockey stick as a person practices puck handling to thereby avoid having to chase a loose puck.

2. The hockey training device of claim 1 wherein said swivel is a fishing swivel and said leader is a fishing leader.

3. The hockey training device of claim 1 wherein said leader is a nylon coated steel leader.

4. The hockey training device of claim 1 wherein said leader has a minimum strength of at least 60 pounds.

5. The hockey training device of claim 1 wherein the strap has a plurality of hook members on one end of said strap and a plurality of eye members on the other end of the strap to releaseably secure said strap to a hockey stick.

6. A hockey training device to enable a person to practice puck handling comprising:

a leader, said leader having a first end and a second end;

a stop attached to said second end for securing said leader to a hockey puck;

a swivel attached to said first end to permit rotation of said leader without twisting of the leader;

a strap, securable to a hockey stick and to said swivel to thereby hold a hockey puck proximate said hockey stick as a person practices puck handling to thereby avoid having to chase a loose puck; and a hockey puck wherein a diametrical opening in said hockey puck is sufficiently small to prevent said stop from being pulled therethrough but sufficiently large to enable said swivel to be pulled therethrough to allow a user to thread a new swivel and leader if the leader should break.

7. The hockey training device of claim 6 wherein the stop comprises a plastic bead.

8. A hockey training device to enable a person to practice puck handling comprising:

a leader, said leader having a first end and a second end;

a stop attached to said second end for securing said leader to a hockey puck;

a swivel attached to said first end to permit rotation of said leader without twisting of the leader;

a strap, securable to a hockey stick and to said swivel to thereby hold a hockey puck proximate said hockey stick as a person practices puck handling to thereby avoid having to chase a loose puck; wherein said strap is fabric and an elastic member is sewn to said strap.

9. The hockey training device of claim 8 wherein said hockey puck has a chamber sufficiently small so as to frictionally engage said stop to prevent said stop from falling out of said hockey puck.

* * * * *